United States Patent [19]

Dalzell et al.

[11] 3,970,507

[45] July 20, 1976

[54] TAPE DISPENSER AND METHOD OF DISPENSING TAPE

[75] Inventors: Chester G. Dalzell; Burton D. Pace, both of Ogallala, Nebr.

[73] Assignee: TRW Inc., Ogallala, Nebr.

[22] Filed: Oct. 17, 1974

[21] Appl. No.: 515,707

[52] U.S. Cl. ..... 156/446; 156/185; 156/468; 156/522

[51] Int. Cl.[2] ..... B65C 3/12

[58] Field of Search ..... 156/446, 468, 510, 516, 156/518, 522, 486, 443, 185, 475; 93/36.9; 53/137

[56] References Cited

UNITED STATES PATENTS

| | | | |
|---|---|---|---|
| 3,152,945 | 10/1964 | Jackson | 156/522 |
| 3,362,863 | 1/1968 | Larsson et al. | 156/486 X |
| 3,380,873 | 4/1968 | Angst | 156/446 |
| 3,560,308 | 2/1971 | Buck | 156/522 |
| 3,574,041 | 4/1971 | Melle | 156/522 |
| 3,607,572 | 9/1971 | Jorgensen | 156/522 X |

*Primary Examiner*—David A. Simmons
*Attorney, Agent, or Firm*—Poms, Smith, Lande & Glenny

[57] ABSTRACT

A tape dispenser for use in winding tape about a rotating body generally includes a frame mounted on a base with adhesive tape mounted on a reel on the frame. The tape is run from the reel to a holding means which in the preferred form is a vacuum surface which holds the tape thereon but permits it to slide along the surface. The tape is fed in a manner in which the adhesive side faces outward from the vacuum surface. The dispenser has displacement means which pivots the frame and moves it toward the rotating body until the body touches the adhesive of the tape at or near the vacuum surface. The rotation of the rotating body causes tape to be payed from the reel until a predetermined length of tape is wound around the body. Thereafter, it is cut between the body and the vacuum surface.

9 Claims, 5 Drawing Figures

TAPE DISPENSER AND METHOD OF DISPENSING TAPE

BACKGROUND OF THE INVENTION

Many electronic components are covered with insulative or sealing tape. In high-speed operations, it is often necessary to feed tape at a very fast rate to a multitude of electronic components. Typically, a partially completed component is fed into a taping station in an automatic machine. Thereafter, a predetermined amount of tape is fed to the electronic component and wound therearound.

The usual prior art method of feeding the tape to the electronic component comprises a series of rollers adapted to feed the tape therethrough. This method utilizes dispensers which were also used for dispensing tape in other environments. The length of tape is determined by the amount of permissible rotation of the rollers. However, the use of rollers has a drawback with adhesive tape because the adhesive tends to stick on the rollers and causes uneven dispensing of the tape. The rollers in prior art devices tend to work better with a tape which must be moistened before it becomes viscid, but the moistening devices must be closely maintained in order to have even wetting of the tape. Moreover, the use of moist tape is unacceptable in many applications, and in those applications, there is a need for a dispenser for adhesive tape.

In order to deal with the adhesiveness of the tape, it has been proposed to have a moving member on the frame of the dispenser which grips the tape and pulls it forward a predetermined distance to pull a predetermined length of tape from the reel. Thereafter, the tape would be cut near the reel and could easily be removed manually from the dispenser. Such a dispenser is set forth in Bevier, Pat. No. 2,988,944. It has a significant drawback in that it requires many moving parts in order to dispense tape.

It has also been proposed to use a vacuum connected to a roller for assisting in dispensing tape where the composition of the tape made is difficult to dispense. Dreher U.S. Pat. No. 3,060,775. However, that device is not adapted to dispense adhesive tape due to the numerous rollers over which the tape passes.

It is, therefore, an object of the present invention to provide a tape dispenser with few moving parts. A further object of the present invention is a dispenser which can dispense tape to a location where it can be utilized automatically by a machine. A further object of the device is to provide a tape dispenser which can be easily controlled through the dispensing and cutting-off functions in cooperation with the controls of an automatic machine for making electronic components or other parts which must be wound with tape. Still a further object of the invention is to provide a tape dispenser to dispense the maximum length of tape in a given amount of time for increasing production. Another object of the invention is to provide a dispenser which will not only dispense tape but will insure that tape wound around the components is sealed against previous tape winds and against the component. Still a further object of the invention is to provide such a device in a compact housing with a few exposed parts so that it can be located in tight locations on a larger machine and can withstand dirt and vibration from such a machine.

SUMMARY OF THE INVENTION

A tape dispenser for dispensing tape to be wound around a rotating part includes supporting means for supporting for rotation a reel of tape and holding means for holding a portion of tape at a position remote from the reel. Cutting means are provided to sever the tape after a predetermined length has been wound around the rotating part. The improvement of the present invention includes the provision of having displacement means to move the holding means from an initial position to a dispensing position in close proximity to the rotating part so that the adhesive on the tape at the remote position contacts the rotating part whereby the tape is gripped by the rotating part so that rotation of the part causes tape to be would around the part. The improvement may also include the provision of having control means to initiate the displacement means when a rotating part without tape thereon is located in a position that movement to the dispensing position of the holding means by the displacement means would move the holding means to the location proximate the rotating part. The control means also causes the displacement means to return the holding means to its initial position after a predetermined amount of tape is wound about the rotating part. The improvement may also comprise the provision of having the control means pivot the dispenser after the tape engages the part to position the cut-off means in an advantageous attitude so that tape is extended between the part and the holding means whereby the control means further initiates the cut-off means to cut the extended portion of tape.

The holding means may comprise a vacuum chamber which holds tape thereon but permits tape to slide thereover. Preferably, the tape is mounted on its reel and is fed to the holding means with the adhesive side up, and the side without adhesive slides on the outer surface of the vacuum chamber. Also preferably, the supporting means for the reel of tape and the holding means for holding the portion of tape are mounted on a frame for movement together. The frame is preferably mounted on a base, and the displacement means slides the frame relative to the base while pivoting means on the frame allows pivoting of the frame by the displacement means. Preferably, a bracket is pivotally connected to the frame, and the bracket is mounted for translation with respect to the base. Generally, the displacing means includes a plurality of fluid driven pistons, one piston primarily pivoting the frame about the pivot and another piston primarily translating the frame along the base.

BREIF DESCRIPTION OF THE DRAWINGS

Figure 5:
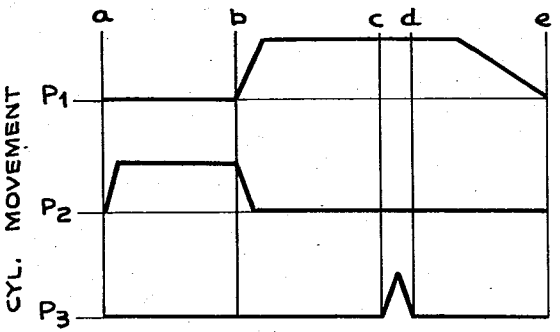

FIG. 5 is a chart showing the amount of piston displacement for each cylinder as a function of time. These displacements are controlled by the control means. The vertical axis on lines $P_1$, $P_2$, and $P_3$ indicate relative extensions of pistons $P_1$, $P_2$, and $P_3$ respectively. The horizontal axis indicates time.

DETAILED DESCRIPTION OF THE PREFERRED EMBODIMENT

The present invention generally comprises a tape dispenser for dispensing tape to be wound around a rotating part and includes preferably a frame mounted on a base. In the exemplary embodiment, the frame 10 includes upstanding sidewalls 11 and 12. The frame member is mounted with respect to the base 20 in a manner to be described hereinafter. It should be recognized that the base 20 could also be a surface on the automatic winding machine with which the tape dispenser is associated. Therefore, a separate base would not be necessary. In the exemplary embodiment, the base is attached to the winding machine 4 by suitable fastening means so that the dispenser may easily be removed from the winding machine. The area on the winding machine to which the dispenser is attached preferably has a housing nearby to hold the electric and/or pneumatic controls associated with the dispenser.

Supportinng means are provided for supporting for rotation a reel of tape. In the exemplary embodiment, such supporting means 13 includes slots 14 in the frame sidewalls. The reel of tape has an axle through the center of the reel, and the axle is supported by slots 14. The axle could be held within the slots by gravity and by the pull of the tape to the right in FIG. 1. In the exemplary embodiment, the axle is provided with a screw thread so that a lock nut 16 could be tightened thereon against the frame to insure that the supporting means would securely hold the reel of tape. Additionally, a pair of low friction washers separate the reel from the frame to minimize friction therebetween and to maintain the reel 2 parallel with the sidewalls 11 and 12.

Figure 1:
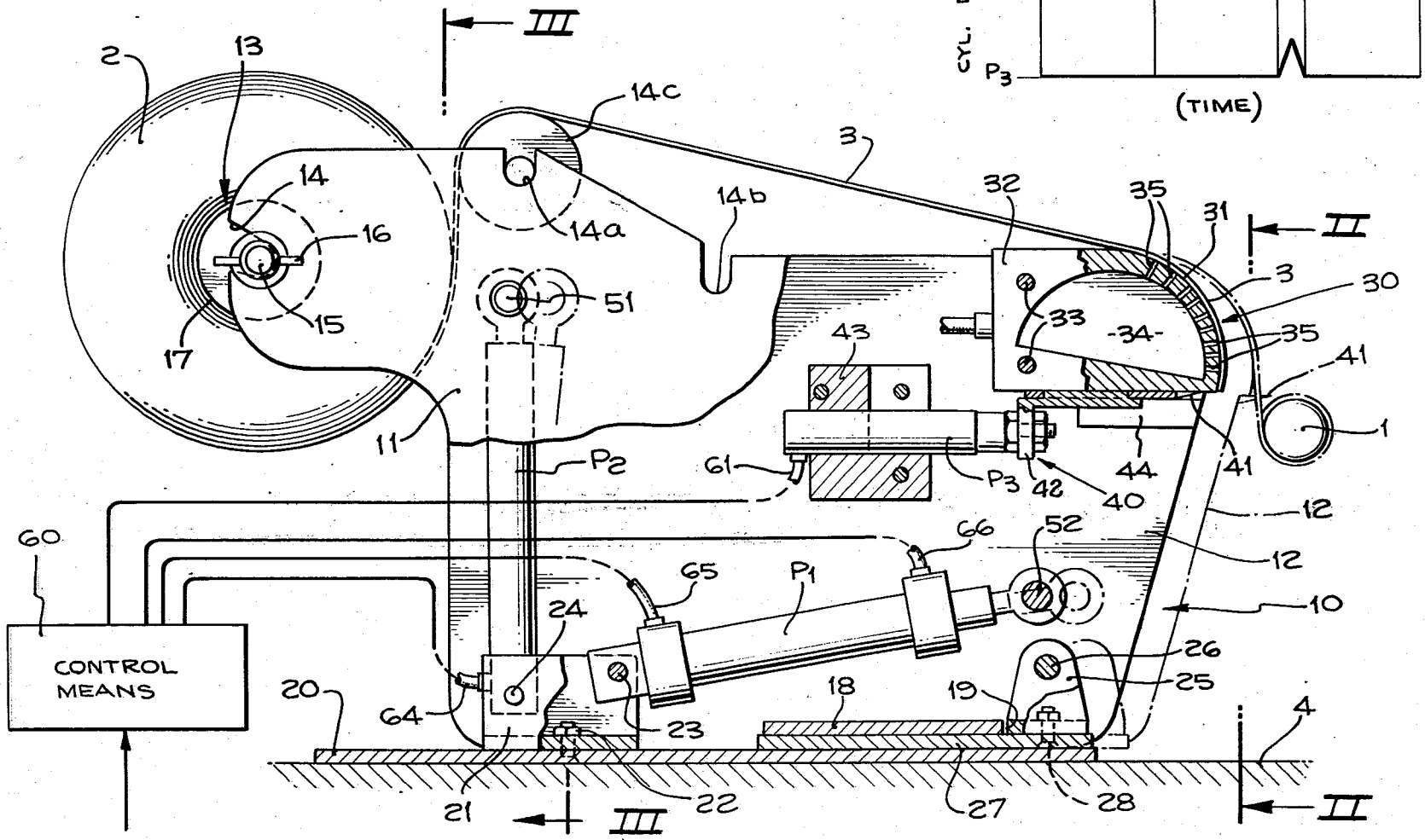
FIG. 1 is a side view, partially cut away, of the tape dispenser embodying the improvement of the present invention and shows the relationship of the winding machine and the member 1 around which tape is to be wound. The broken line configuration shows the dispenser in the correct orientation for tape severing.

Holding means for holding a portion of tape at a location remote from the reel are provided. In the exemplary embodiment, such holding means 30 is mounted in the upper portion of the dispenser remote from the reel of tape. The upper portion is hereinafter sometimes referred to as the "nose" of the dispenser. The holding means of the preferred exemplary embodiment includes a vacuum means 32 against which a portion of the tape 3 is held thereagainst. The vacuum means 32 is supported between the frame sidewalls 11 and 12 by suitable supports 33. The vacuum means includes a vacuum chamber 34 which is connected to a source of vacuum (not shown). A plurality of passages 35 supply the vacuum from the chamber 34 to the surface 31 of the vaccum means. The vacuum causes the ambient air pressure to yield a resulting force to the outer side of the tape 3 against the surface 31 as shown in FIG. 1 but permits the sliding of the tape along surface 31. For reasons set forth below, it is advantageous to have tape which will slide along surface 31 but is held thereagainst by the vacuum. It may also be advantageous to provide guides to guide the tape from the reel to the vacuum chamber. Such guides, if desired, would be locatable in slots 14*a*, 14*b* provided in the sidewalls.

As previously stated, one primary purpose of the invention is to improve the method of applying tape which is to be wound around a moving part such as a rotating capacitor or other electronic component 1. In a manner which will be described in greater detail below, tape from the reel 2 is woound about the rotating member 1. After a predetermined amount of tape is wound thereabout, the cutting means severs the tape. In the exemplary embodiment, the cutting means 40 includes a toothed blade member 41 mounted for reciprocating movement into and out of engagement with the tape between the vacuum chamber and the rotating member as shown in FIG. 1. In the exemplary embodiment, the reciprocating motion is caused by a pneumatically actuated piston $P_3$ which is connected by a suitable bracket 42 to the blade 41. The bracket 42 is mounted for sliding between suitable guides 44 which also support the blade 41. The piston is connected to a pneumatic control device or control means 60 which actuates the piston through pneumatic line 61, at a desired time (the timing of the entire apparatus will be discussed in detail below). The piston is mounted on a bracket 43 located between the sidewalls 11 and 12.

The pneumatic piston $P_3$ is a single acting piston which is spring loaded to the position shown in solid lines in FIG. 1 and which is forced to the broken line FIG. 1 position by pneumatic pressure wherein the blade cuts the tape. In the exemplary embodiment, impulse generator is used to provide quick action to the blade. Thereafter, the spring loading the piston returns the piston to its initial position. However, it should be recognized that the pneumatic piston could be adapted to return to its initial position by pneumatic pressure. It should also be recognized that the pneumatic piston could be replaced by any fluid driven piston or other mechanical driving means. Moreover, the fluid driven pistons could be modified in a number of ways well within the skill of one of ordinary skill in the art. Some of these modifications are set forth in *Tool Engineers Handbook*, 2nd Ed., Chap. 12 (1959).

Displacement means moves the holding means from an initial position to a dispensing position in close proximity to the rotating part so that the adhesive on the tape at the remote position contacts the rotating part and the tape is gripped thereby so that rotation of the rotating part causes tape to be wound around the part. In the exemplary embodiment, tape is fed from the underside of the reel upwards over a roller (not shown) in slot 14*a* so that the adhesive side of the tape is facing upward, and the non-adhesive side of the tape is against the holding means. Also in the preferred exemplary embodiment, movement of the holding means 30 is accomplished by moving the entire frame 10.

It is an important feature of the present invention that the adhesive side of the tape 3 faces outward from vacuum surface 31. This allows that tape to slide along the surface 31 and does not interfere with dispensing of the tape. Obviously, if the adhesive were mounted on the inside-facing side of the tape which would occur if tape were fed directly from the top of the reel to the holding means, the adhesive would interfere with feeding the tape along the vacuum surface 31. When the holding means moves to a position adjacent the rotating member (FIG. 4) the adhesive on the tape contacts the rotating member and sticks to the member. Subsequently, the rotation of the member causes tape to be pulled from the reel and be wound about the rotating member.

By feeding the tape over surface 31 of the vacuum chamber, the location of the free end of tape is always assured to be at the bottom edge of vacuum chamber 32 because the cutting blade cuts the tape immediately adjacent the chamber Because the tape is held against the vacuum surface 31, there is no dangling end which can grip the rotating part at an undesirable angle and cause bulges or folds in the tape about the capacitor. Moreover, the surface 31 is held against the rotating member during winding, and the force exerted thereagainst seals successive winding of tape and prohibits folds or bulges in the tape.

Figure 3:
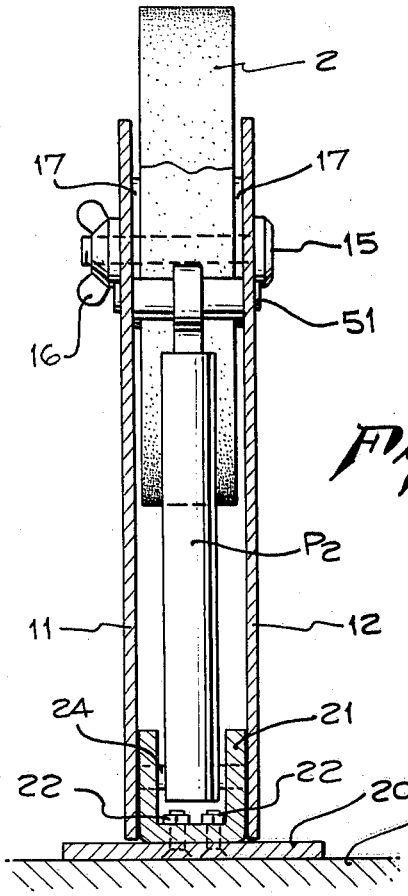
FIG. 3 is a sectional view of the tape dispenser of the present invention and is taken along the plane III—III of FIG. 1.
Figure 2:
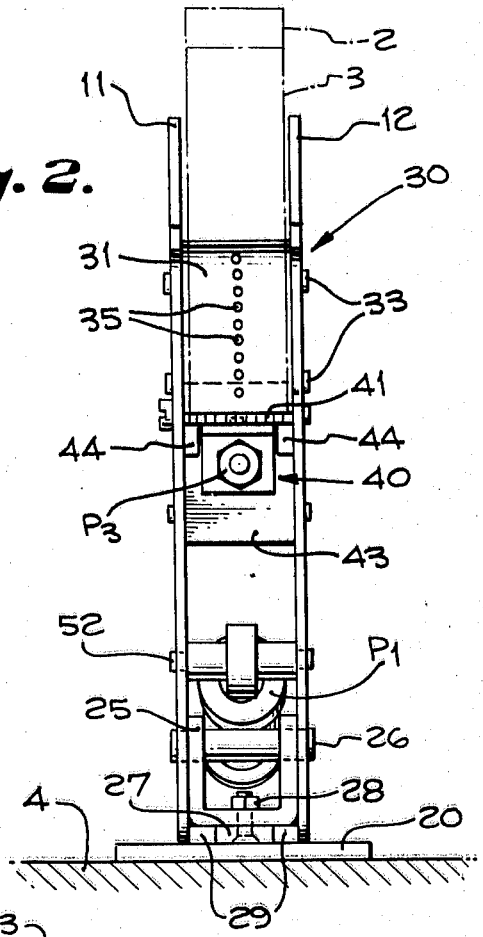
FIG. 2 is a front view of the improved tape dispenser taken along the plane II—II of FIG. 1.

As stated above, the holding means is mounted on the frame and the displacement means which move the holding means to its location adjacent the rotating member also moves the frame therewith. The displacing means includes at least one fluid driven piston. Preferably, the displacing means includes a plurality of fluid driven piston means, one piston means primarily pivoting the frame means about the pivot and another piston primarily translating the frame along the base. In the preferred exemplary embodiment, a U-shaped member 21 is fixedly attached to the base 20 by means of bolts 22 or other fastening devices (FIG. 3). Two pneumatic driven pistons $P_1$ and $P_2$ are pivotally attached to the U-shaped member about shafts 23 and 24 respectively. The U-shaped member 21 is mounted between the sidewalls 11 and 12 and the sidewalls are free to move relative to the U-shaped member.

Bracket means is pivotally connected to the frame means. The bracket is mounted for translation with respect to the base whereby the displacing means pivots the frame about the pivot and translates the frame along the base. In the exemplary embodiment, the bracket means includes a U-shaped bracket 25 carrying a shaft 26 which supports the sidewalls 11 and 12 for pivoting movement thereabout. Bracket 25 is attached to inner guide member 27 by bolt 28 and the inner guide member is mounted for sliding movement between outer guide member 29. The inner guide member 27 is also prevented from moving in the vertical direction by upper guide plate 18 which stradles the outer guide members 29 to crreate an elongated slot surrounded by the base 20, the upper guide plate 18, and the outer guide members 29. It is through the elongated slot that the inner guide member 27 slides. The end 19 of the upper guide plate 18 serves as a stop to limit movement to the left (FIG. 1) of the bracket 25.

Figure 4:
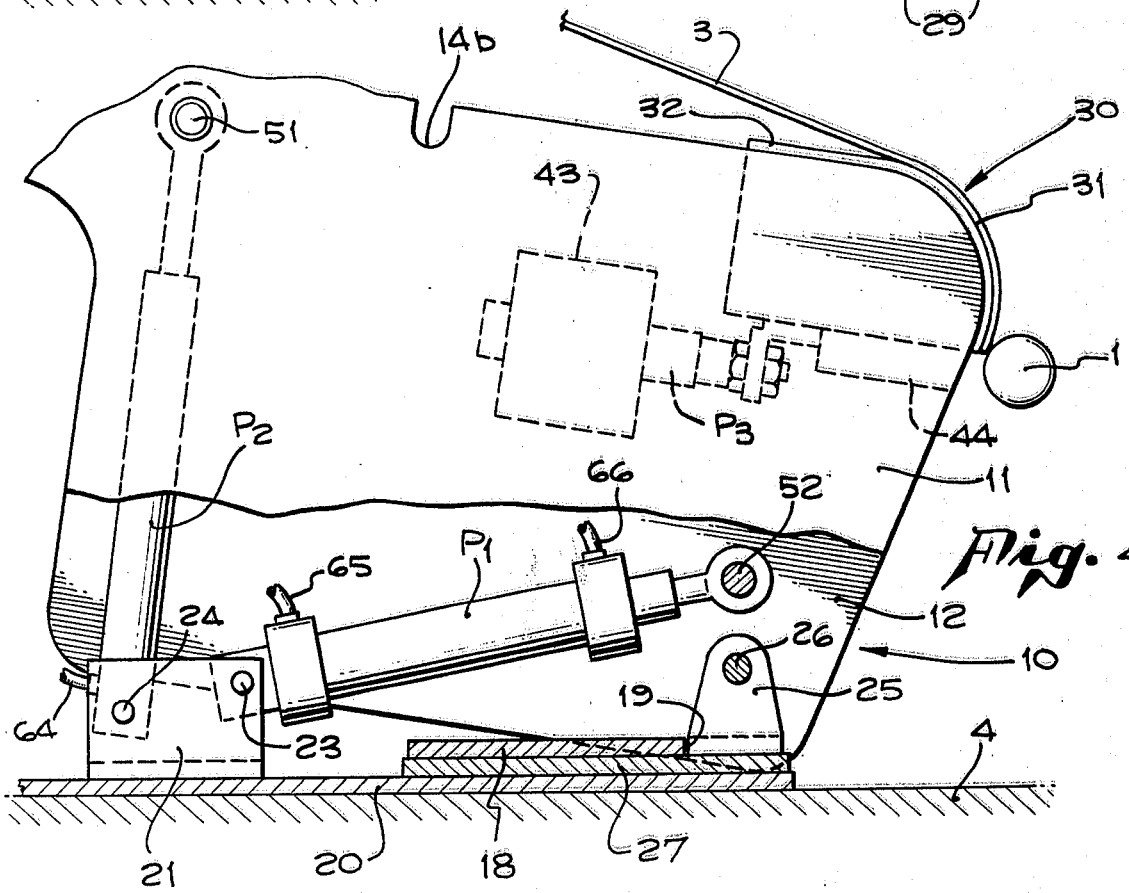
FIG. 4 is a partial cut-away side view of the dispenser of the present invention showing the dispenser moved to a position proximate the rotating body whereby the adhesive on the tape contacts the rotating body to be gripped thereby.

In the exemplary embodiment, the fluid driven piston $P_2$, which in the exemplary embodiment is a pneumatic piston is attached to the U-shaped member 21 at a shaft 24 and is connected to the frame by shaft 51. At a predetermined time the control means 60 through line 64 actuates the fluid driven piston causing the piston to extend from its position shown in solid line in FIG. 1 to an extended position as shown in FIG. 4. The movement causes a raising of the frame 10 away from the U-shaped member 21 and because the frame is pivotally attached to the bracket 25, the entire frame pivots in a clockwise direction about the shaft 26 on bracket 25. The pivoting causes the "nose" of the dispenser to contact the part 1 whereby the adhesive tape grips the part. Thereafter rotation of the part pulls tape from the reel and onto the part.

In the exemplary embodiment the control device also actuates another piston $P_1$ through lines 65 and 66 which is likewise connected to the U-shaped member 21 at the shaft 23 and is also pivotally connected to the frame at shaft 52. Actuation of piston $P_1$ by pneumatic pressure through lines 65, 66 causes a force to be applied to the frame 10 to the right so that the device moves from the solid line position to the broken line position in FIG. 1. The frame is free to move to its right because of its connection in inner guide member 27 which is free to slide relative to the other guide members 18, 20, and 29.

Because the piston $P_1$ does not act directly through the pivoting axis of shaft 26, it could contribute to the pivoting as well as to the translating to the right of frame 10 in FIG. 1. However, its primary function is to translate the frame to the right. Moreover, in the construction of the preferred embodiment, both pivoting and translating contribute to the proper functioning of the device for reasons set forth below. However, it is possible to construct the device and eliminate either the sliding or the translting of the frame. Also, it is possible to accomplish both sliding and pivoting by means of one piston. As previously stated, piston $P_1$ could contribute to the pivoting as well as the translating. By modification of the location of the shaft with which a piston is connected to the frame, a modification of the pivoting and translating would be effected.

OPERATION

The invention has its primary purpose as an automatic tape dispenser for winding tape around electronic components, primarily capacitors, in order to seal such components and protect them from dust and moisture. Accordingly, such a component or member 1 is mounted for rotation on an automatic machine. The tape dispenser of the present invention is mounted nearby. Control means on the automatic machine initiates rotation of member 1. Simultaneously or subsequent to the initiation of rotation of member 1, the control means associated with the tape dispenser causes the pneumatic system to fully extend pisotn $P_2$ and consequently displaces the frame to the position shown in FIG. 4. The control means may be chosen from many types of known pneumatic controllers. Control may be affected by sensors detecting rotation of the member 1, or a timer in control means 60 may initiate movement in the pneumatic pistons. Moreover, it would be possible to have the control means 60 part of the controller for the automatic mahine. See *Tool Engineers Handbook*, supra.

The extension of piston $P_2$ causes the tape on the vacuum surface 31 to contact rotating member 1. Because the adhesive is facing outwardly, rotating member 1 contacts the adhesive side of the tape, and the tape is gripped by the rotating member. Rotation of the member causes tape to be payed from reel 2 and it is pulled along vacuum surface 31. The piston $P_2$ forces vacuum surface 31 against rotating member 1 which causes the complete sealing of adhesive tape 3 against the rotating member.

The initial operation is illustrated in the control chart shown in FIG. 5 wherein the control means initiate the displacement means when a rotating part without tape thereon is located in a position that movement to the dispensing position of the holding means by the displacement means would move the holding means to the position proximate the rotating part. In FIG. 5, this is indicated at time *a* by the initial increase in the displacement of piston $P_2$. The amount of extension of piston $P_2$ in FIG. 5 is for illustration only to indicate full extension at *a*, and the length of extension would vary as the configuration of the device varied. It is recognized that rotation of member 1 could begin prior to or concurrently with the activation of piston $P_2$.

After part 1 is wound with the correct amount of tape, the tape must be severed. However, when the dispenser is in the FIG. 4 position, acutation of piston $P_3$ might cause the blade to damage part 1. Therefore, the "nose" is brought to a different orientation by the retraction of piston $P_2$ with the concurrect extension of piston $P_1$. As discussed above, piston $P_1$ displaces the dispenser horizontally. The exemplary embodiment is designed so the nose assumes a position shown in broken lines in FIG. 1. The pistons movements are illustrated between positions *b* and *c* in FIG. 5. Note that when piston $P_3$ is activated between positions *c* and *d* of FIG. 5, the blade does not contact part 1, as shown in broken lines in FIG. 1.

The blade cuts the tape while part 1 is rotating in order to maintain high production with the device. Of course, once the tape is severed, the feeding of tape from the reel ceases because the pull from the tape on part 1 is no longer transmitted to the reel of tape. It is recognized that the tape part 1 could be stopped prior to tape severing but this would slow production.

The cut-off is made on the tape near the bottom end of vacuum surface 31 in order to insure that there is not a long length of tape extending beyond surface 31 after cut-off so that the next member that is wound with tape will only contact tape that is against the surface. This decreases the possibility of bulges or folds in the initial winding of the tape. It should also be recognized that the tape is severed very close to the rotating part so that there will be no tape end to be easily pulled away from the rotating part.

After the tape is severed, the control means causes piston $P_1$ and consequently the entire dispenser, to return to the initial solid line FIG. 1 position (note time *e* on FIG. 5). Thereafter, another member 1 would be brought into place and the entire operation repeated.

It should be recognized that the location of the member 1 relative to the dispenser could be modified in many ways. Moreover, it is not absolutely necessary to have the FIG. 1 broken line position for the dispenser between the actuated position (FIG. 4) and the initial position (FIG. 1). However, because of the ease with which the pneumatic pistons can move the dispenser and in view of potential advantages to the removal of finished wound parts and the movement into place of parts to be wound, it is advantageous to have an initial position for transferring the members 1 and a second cutting position in order to prevent part damage during severing of the tape.

It should also be recognized that with the present invention, it is extremely easy to change reels of tape when they are either spent or a different type of tape is required. No threading of the tape is necessary through a complicated set of rollers. It is only necessary to pull a short length of tape from the reel to the vacuum holding means. Also, because there is no contact between the adhesive on the tape and any part of the tape dispenser, the dispenser remains relatively free from potential jams. As there are no rollers to feed the tape, very little lubrication is required.

We claim:

1. In a tape dispenser for dispensing tape to be wound around a rotating part including supporting means for supporting the rotation of a reel of tape and holding means for holding a portion of the tape at a position remote from the reel and cutting means to sever the tape after a predetermined length has been wound around the rotating part, said holding means and cutting means being mounted on a frame, displacement means to move the holding means from an initial position to a dispensing position in close proximity to the rotating part so that the adhesive on the tape at said remote position contacts said rotating part, and the tape is gripped thereby so that the rotation of the rotating part causess tape to be wound around the part, the improvement comprising the provision of:

said displacement means including first driving means primarily for pivoting said frame about a pivot so that the holding means moves to said disensing position and for pivoting said frame back to said initial position, and second driving means for translating said frame after said first driving means pivots said frame to said dispensing position, said second driving means translating said frame to a position such that the holding means is in a cutting position proximate to the rotating part so that a free end of tape on the holding means would not contact the rotating part after the tape is cut by said cutting means.

2. The improvement of claim 1 further including the provision of said control means modifying the movement of the holding means to its initial position thereby extending tape between the rotating part and the holding means and moving said cut-off means to an orientation where it severs the tape without damaging the rotating part, said control means further initiating said cut-off means to cut said extended portion of tape.

3. The improvement of claim 1 further including the provision of:

said frame being mounted on a base, the displacement means sliding said frame relative to said base, bracket means pivotally connected to said frame means at a pivot, said bracket mounted for translation with respect to the base whereby said displacing means pivots said frame means about said pivot and translates said frame along said base.

4. The improvement of claim 1 further including the provision of cutter mounting means adjacent the holding means for mounting the cutting means adjacent the holding means in a position whereby the cutting means would cut tape wound on the part if the cutting means were activated when the holding means is in said dispensing position and whereby said cutting means misses said wound tape when the cutting means is activated when the holding means is in said cutting position so that the cutting means can be close to the wound part so that the length of tape between the cutting means and the wound part is minimized.

5. The improvement of claim 1 further including control means for initiating said first driving means when a rotating part to be wound with tape is mounted near the dispenser to drive said holding means to its dispensing position and for initiating said first driving means to return to its initial position and initiating said second driving means to drive said holding means to its cutting position when the tape contacts the rotating part and is being wound thereon.

6. In a tape dispenser for dispensing tape to be wound around a rotating part including supporting means for supporting the rotation of a reel of tape and holding means for holding a portion of the tape at a position remote from the reel and cutting means to sever the tape after a predetermined length has been wound around the rotating part, the improvement comprising the provision of displacement means to move the holding means from an initial position to a dispensing position in close proximity to the rotating part so that the adhesive on the tape at said remote position contacts said rotating part, and the tape is gripped thereby so that the rotation of the rotating part causes tape to be wound around the part, the improvement further comprising the provision of having said frame being mounted on a base, said displacement means sliding said frame relative to said base, and pivoting means on said frame for allowing pivoting of said frame by said displacement means, bracket means pivotally connected to said frame means at a pivot, said bracket mounted for translation with respect to the base whereby said displacing means pivots said frame means about said pivot and translates said frame along said base, said displacement means further including a plurality of fluid driven pistons, one of said pistons primarily pivoting said frame about said pivot, and another of said pistons primarily translating said frame along said base.

7. In a tape dispenser for dispensing tape to be wound around a rotating part including supporting means for supporting the rotation of a reel of tape and holding means for holding a portion of the tape at a position remote from the reel and cutting means to sever the tape after a predetermined length has been wound around the rotating part, said holding means and cutting means being mounted on a frame, displacement means to move the holding means from an initial position to a dispensing position in close proximity to the rotating part so that the adhesive on the tape at said remote position contacts said rotating part, and the tape is gripped thereby so that the rotation of the rotating part causes tape to be wound around the part, the improvement comprising the provision of:

said displacement means including first driving means primarily for pivoting said frame about a pivot so that the holding means moves to said dispensing position and for pivoting said frame back to said initial position, and second driving means for translating said frame to a position such that the holding means is in a cutting position proximate to the rotating part so that a free end of tape on the holding means would not contact the rotating part after the tape is cut by said cutting means, cutter mounting means adjacent the holding means for mounting the cutting means adjacent the holding means in a position whereby the cutting means would cut tape wound on the part if the cutting means were activated when the holding means is in said dispensing position and whereby said cutting means misses said wound tape when the cutting means is activated when the holding means is in said cutting position so that the cutting means can be close to the wound part so that the length of tape between the cutting means and the wound part is minimized, and whereby said holding means comprises a generally curved surface, the tape extending over the holding means and extending from one side of the curved surface to the tape supporting means, and the other side of the curved surfaces being in such a position that it is proximate the wound part when said holding means is in said dispensing position.

8. The improvement of claim 7 whereby said cutter mounting means mounts the cutting means perpendicular to the curved surface at said other side of the curved surface.

9. In a tape dispenser for dispensing tape to be wound around a rotating part including supporting means for supporting the rotation of a reel of tape and holding means for holding a portion of the tape at a position remote from the reel and cutting means to sever the tape after a predetermined length has been wound around the rotating part, said holding means and cutting means being mounted on a frame, displacement means to move the holding means from an initial position to a dispensing position in close proximity to the rotating part so that the adhesive on the tape at said remote position contacts said rotating part, and the tape is gripped thereby so that the rotation of the rotating part causes tape to be wound around the part, the improvement comprising the provision of:

said displacement means including first driving means primarily for pivoting said frame about a pivot so that the holding means moves to said dispensing position and for pivoting said frame back to said initial position, and second driving means for translating said frame to a position such that the holding means is in a cutting position proximate to the rotating part so that a free end of tape on the holding means would not contact the rotating part after the tape is cut by said cutting means, cutter mounting means adjacent the holding means for mounting the cutting means adjacent the holding means in a position whereby the cutting means would cut tape wound on the part if the cutting means were activated when the holding means is in said dispensing position and whereby said cutting means misses said wound tape when the cutting means is activated when the holding means is in said cutting position so that the cutting means can be close to the wound part so that the length of tape between the cutting means and the wound part is minimized, and wherein said displacement means comprises means for changing the angle of travel of the cutting means with respect to the rotating part.

* * * * *

UNITED STATES PATENT AND TRADEMARK OFFICE

CERTIFICATE OF CORRECTION

PATENT NO. : 3,970,507

DATED : July 20, 1976

INVENTOR(S) : Chester G. Dalzell and Burton D. Pace

It is certified that error appears in the above-identified patent and that said Letters Patent are hereby corrected as shown below:

Col. 3, line 30, "Supportinng" should be --Supporting--;

Col. 4, line 8, "woound" should be --wound--, and in line 58,"that" should be --the--;

Col. 5, line 45, "crreate" should be --create--;

Col. 6, line 20, "translting" should be --translating--, in line 40, "pisotn" should be --piston--, and in line 48, "mahine" should be --machine--.

Col. 8, line 12, "causess" should be --causes-- occurring in claim 1.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*